United States Patent [19]

Lehnhoff

[11] Patent Number: 4,642,920

[45] Date of Patent: Feb. 17, 1987

[54] DIGGER TOOTH ARRANGEMENT

[75] Inventor: Peter A. Lehnhoff, Baden-Baden, Fed. Rep. of Germany

[73] Assignee: Lehnhoff Hartstahl GmbH & Co., Baden-Baden, Fed. Rep. of Germany

[21] Appl. No.: 805,890

[22] Filed: Dec. 6, 1985

[30] Foreign Application Priority Data

Dec. 6, 1984 [DE] Fed. Rep. of Germany ..... 3444563

[51] Int. Cl.[4] ..... E02F 5/00

[52] U.S. Cl. ..... 37/141 T

[58] Field of Search ..... 37/141 R, 141 T, 142 R, 37/142 A, 118 R; 299/91-93

[56] References Cited

U.S. PATENT DOCUMENTS

| | | | |
|---|---|---|---|
| 1,519,101 | 12/1924 | Armstrong | 37/142 R |
| 2,385,395 | 9/1945 | Baer | 37/142 A |
| 2,740,212 | 4/1956 | Werkheiser et al. | 37/142 R |
| 3,371,437 | 3/1968 | Wilson et al. | 37/142 R |
| 3,791,054 | 2/1974 | Bierwith | 37/141 R |
| 3,919,792 | 11/1975 | Hahn et al. | 37/142 R |
| 4,516,339 | 5/1985 | Hemphill | 37/141 T |

FOREIGN PATENT DOCUMENTS

| | | | |
|---|---|---|---|
| 2114498 | 10/1972 | Fed. Rep. of Germany | 37/142 R |
| 2258303 | 6/1973 | Fed. Rep. of Germany | 37/142 R |
| 2851442 | 6/1979 | Fed. Rep. of Germany | 37/142 R |
| 2264140 | 10/1975 | France | 37/142 R |
| 2277944 | 2/1976 | France | 37/141 R |
| 606934 | 4/1978 | U.S.S.R. | 37/141 R |

*Primary Examiner*—E. H. Eickholt

*Attorney, Agent, or Firm*—Stonebraker, Shepard & Stephens

[57] ABSTRACT

The arrangement of the digger teeth of an excavating bucket of a bucket wheel excavator is described, wherein the excavating bucket is equipped with replaceable corner, center and side teeth of identical construction and dimensions, but which are mounted with respect to the upper edge of the excavating bucket in different angular relationships. The configuration of a digger tooth for use in this arrangement is also included.

8 Claims, 9 Drawing Figures

DIGGER TOOTH ARRANGEMENT

TECHNICAL FIELD AND BACKGROUND ART

This invention relates to an improved digging tooth arrangement for use in a bucket wheel excavator having buckets with replaceable center, corner and side teeth.

Excavators of this type are conventionally adapted to excavate the ground or rock by means of buckets provided on a rotating wheel so as to be moved around an arc. The buckets in order to be efficient in operating on hard rock or when used for dredging have to be equipped with digger teeth which in regard to their configuration and arrangement must be adapted to suit the particular cutting action and must be capable of continuously clearing the wheel. To meet these requirements it is common practice to employ center, corner and side teeth of different formations and dimensions; see "Der Schaufelradbagger als Gewinnungsgerät" (Bucket Wheel Excavator applied as a Winning Machine), 1st edition 1973, TRANS. TECH. PUBLICATIONS, page 121.

This known construction and arrangement involves, however, high storage costs and maintenance handicaps. A further disadvantage resides in their screwed connection with the bucket wall, as this besides weakening the material renders the replacement of the digger teeth difficult, since the fastening screws are located close to the material to be excavated.

It is an object of the present invention to improve the arrangement of digger teeth on the buckets of a bucket wheel excavator. Another object of the invention is to provide a digger tooth of novel construction suitably configured and arranged on a bucket so as to permit more efficient operation on hard rock and in dredging as has hitherto been possible, yet presenting a longer useful life and reduced assembly and maintenance times.

To achieve these objects, the invention provides a digger tooth arrangement of the type specified wherein the center, corner and side digging teeth are identical in configuration and dimensions, the center axes of one or more of the center teeth arranged in one or more perpendicular section planes cutting the bucket in the center or equally spaced thereto are disposed normal to the upper edge of the bucket, wherein the center axes of the corner teeth disposed in the plane comprising the front wall of the bucket are positioned so as to include equal, but opposed angles with the upper edge of the bucket and wherein the center axes of the side teeth arranged in the plane comprising the side walls of the bucket are positioned so as to respectively include unequal angles oriented in the same direction with the respect to the upper edge of the bucket.

According to a further features of the invention the inclination angle of the corner teeth is 10° to 20°, preferably 15°, and the angles of inclination of the side teeth increase respectively by 5° within a range of 5° to 20°, preferably to obtain 5°, 10° and 15°.

It is particularly advantageous if the angular position of the digger teeth which are removably secured to the front wall of the bucket includes an angle $\alpha$ (alpha) in the range of 30° of 50°, preferably 43°, and a clearance angle $\gamma$ (gamma) in the range of 20° to 28°, preferably 23°, while the angle $\alpha$ (alpha) included by the digger teeth removably secured to the side walls ranges from 30° to 50°, preferably 48°, the clearance angle $\gamma$ (gamma) ranging from 20° to 28°, preferably 18°.

The digger teeth are suitably secured in sockets welded to the outer walls of the bucket, the inner walls of the sockets being adapted to receive the complementary shaped outer surfaces of the shank of the digger tooth.

According to a further feature of the invention the digger tooth formed as an integral part comprises a tooth base and a tooth shank with a bead serving as an abutment disposed therebetween, said tooth base having a bottom portion which with respect to a planar contact surface of the tooth shank presents a surface positively inclined by 1° to 3°, preferably 2°, whereas the upper portion of the tooth base with respect to said contact surface presents a surface negatively inclined by 20° to 25°, preferably 23°, the rake angle of the tooth base being 19° to 22°, preferably 21°.

The tooth shank according to the invention is a truncated pyramid forming an irregular hexagon base and having two planar surfaces disposed opposite to each other, one of said surfaces forming the perpendicular contact surface with respect to the pyramid base, whereas the further surfaces of the truncated pyramid are disposed relatively opposite each other in pairs to include an angle of about 168°, said tooth base in the area directed away from said cutting edge essentially forming a double T section, so that recesses between the legs of said double T are provided on the upper portion and on the bottom portion of said tooth base.

To removably fasten the digger tooth on the bucket wall the contact surface of the digger tooth is provided with a projection to be engaged by a retaining lug, said retaining lug by means of a threaded bolt extending through the end of the socket away from the digger tooth and carrying a closure cap, said closure cap being secured by means of a lock nut to the adjacent end of said socket.

For special applications it is preferred to configure the tooth base of the digger tooth according to the present invention as a pointed tooth of cross-shaped section.

Due to the novel configuration of the digger teeth and the selection of predetermined angular positions of these teeth, it is now possible to devise an arrangement which uses identical digger teeth for any of the center, corner and side teeth and which takes into account the specific requirements of different cutting actions by an appropriate selection of the angular position of the digger teeth with respect to the upper edge of the respective bucket and of the inclination of the sockets in which the teeth are received.

Considering that a conventional excavator of the type referred to generally comprises about fifteen buckets, each being equipped with nine digger teeth, it will readily be appreciated that the application of identical digger teeth considerably simplifies the manufacture of the digger teeth and facilitates their assembly and maintenance. Since the sockets supporting the digger teeth are welded to the respective bucket, the possibility of false mounting when replacing the digger teeth is prevented. To ensure proper welding of the sockets to the outer walls of the bucket, mounting surfaces are provided. The bead provided in accordance with the invention completely covers the upper end of the socket to protect it against wear and clogging. The arrangement of the retaining elements at the rearward end of the socket and on the side away from the tooth base prevents these elements from being damaged by the material to be excavated, thus rendering their disconnection easier than before. Finally, by proper selection of the cutting and clearance angles perfect clearance of the wheel is ensured even under severe operating conditions, with the result of increased removal rates.

BRIEF DESCRIPTION OF THE DRAWINGS

One embodiment of the invention will now be described, by way of example only, with reference to the accompanying drawings, wherein.

On the slightly inwardly sloping walls of an excavating bucket 1 (FIG. 1) for use on a digging wheel of a bucket-type excavator not shown, there are provided, in this embodiment, nine replaceable digger teeth $B_1$ to $B_9$, out of which three digger teeth are associated to each of the two lateral walls 2 and 3, while the remaining three digger teeth are arranged on the front wall 4 of the bucket. For securing the digger teeth there are provided generally U-shaped sockets $H_1$ to $H_9$ suitably welded to the outer walls of the bucket so as to be flush with the upper edge K of the bucket. The inner walls 5, 6 and 7 of the sockets are respectively adapted to receive the complementary shaped outer surfaces of the shank of the digger tooth, yet to be described in more detail, see also FIG. 8.

Figure 1:
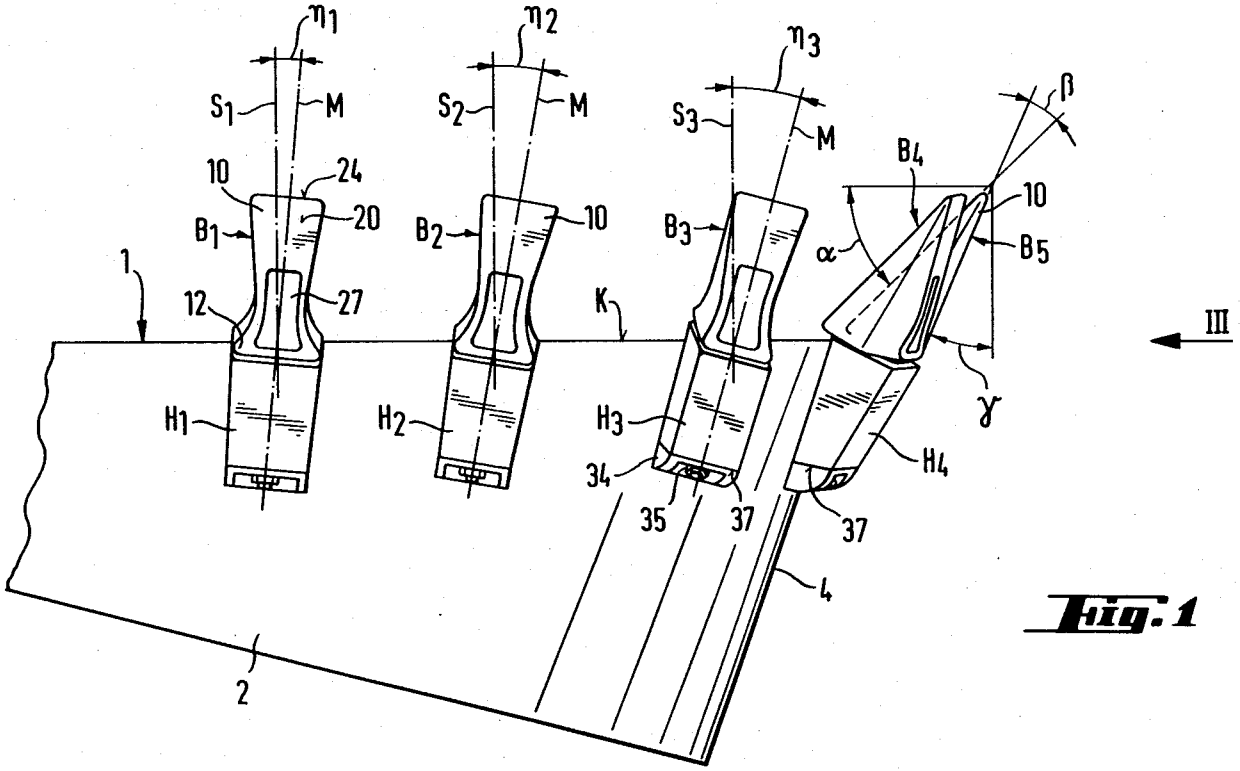
FIG. 1 is a side elevational view of an excavating bucket provided with digger teeth arranged according to the invention.
Figure 2:
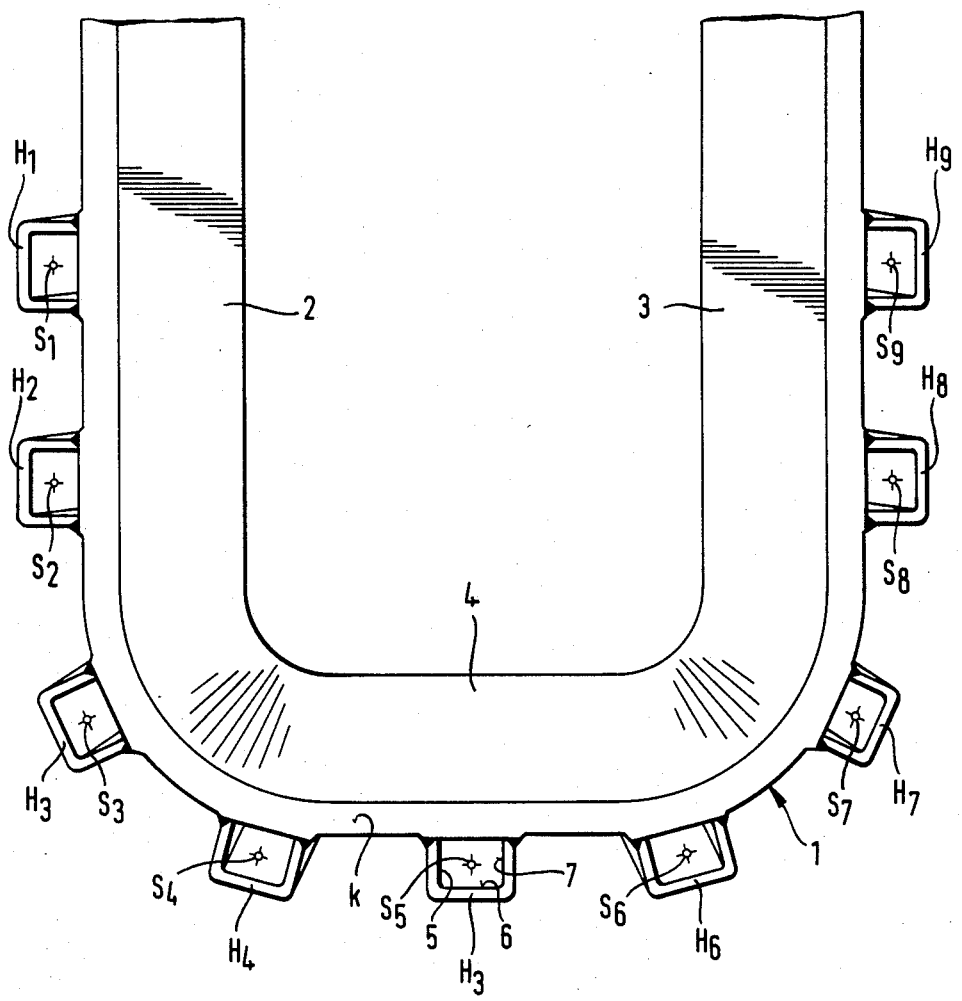
FIG. 2 is a plan view of the excavating bucket shown in FIG. 1, but with the digger teeth being removed.
Figure 3:
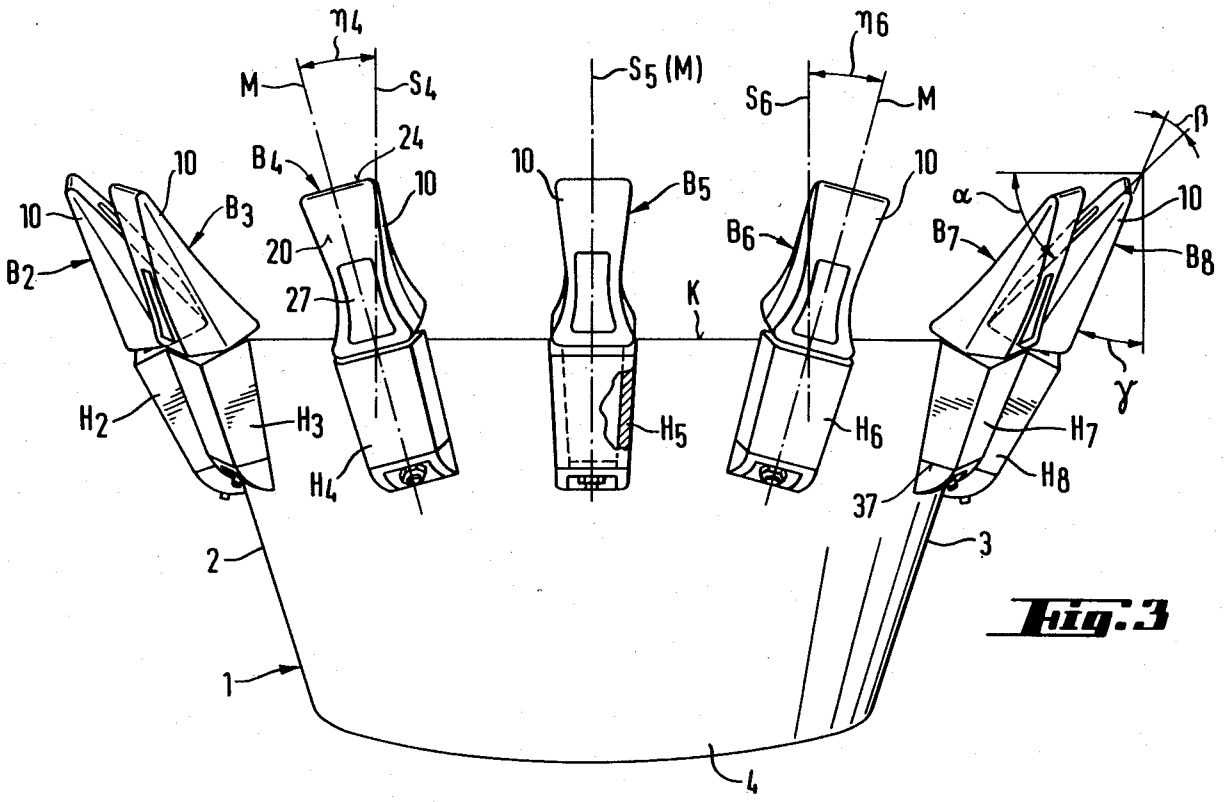
FIG. 3 is an elevational view of the front wall of the excavating bucket shown in FIG. 1.

The sockets H, as can best be seen from FIGS. 1 and 3, are welded to the outer walls of the bucket in various angular relationships to form angles $\eta_1$ to $\eta_9$ ($eta_1$ to $eta_9$) with respect to the normals $S_1$ to $S_9$. Accordingly, the digger teeth $B_1$ to $B_9$ to be received in the sockets $H_1$ to $H_9$ present different slope angles $\eta$(eta). If, with reference to FIG. 2, the digger teeth $B_4$ and $B_6$ respectively associated to the side walls 2 and 3 are called corner teeth and the digger tooth $B_5$ is termed center tooth, then it can be said that the center axes of one or more of the center teeth arranged in a plane cutting the bucket 1 perpendicularly in the center or equally spaced thereto are disposed perpendicularly to the upper edge of the bucket, that the center axis M of each of the corner teeth $B_4$ and $B_6$ arranged in the plane including the front wall 4 of the bucket 1 is inclined with respect to the upper edge of the bucket at equal angles $\eta_4$ and $\eta_6$ ($eta_4$ and $eta_6$) but oriented in different directions, that the center axes M of the lateral or side teeth $B_1$ to $B_3$ and $B_7$ to $B_9$ arranged in the plane including the side walls 2 and 3 of the bucket 1 are positioned in different angular relationships with respect to the upper edge of the bucket 1 (angles $\eta_1$ to $\eta_3$ and $\eta_7$ to $\eta_9$=$eta_1$ to $eta_3$ and $eta_7$ to $eta_9$) but oriented in the same direction.

Various tests have shown that the angles of inclination $\eta_4$ and $\eta_6$ ($eta_4$ and $eta_6$) of the corner teeth $B_4$ and $B_6$ may be 10° to 20°, preferably however 15°, whereas the angles $\eta_1$ to $\eta_3$ and $\eta_9$ to $\eta_7$ ($eta_1$ to $eta_3$ and $eta_9$ to $eta_7$) of the side teeth $B_1$ to $B_3$ and $B_9$ to $B_7$ increase by 5° within a range of 5° to 20° starting at a point located inwardly, i.e. from the left in FIG. 1, towards the outermost portion defined by the front wall. It is preferred that the center axes M are inclined at an angle of 5°, 10° and 15° with respect to the normals $S_1$ to $S_3$. The same applies to the center axes M associated to the normals $S_9$ to $S_7$ of the side teeth $B_7$ to $B_9$, not visible in FIG. 1.

To facilitate the welding of the channel-shaped sockets $H_1$ to $H_9$ to the bucket, the side walls and the front wall (2 to 4) of the bucket 1 are provided with mounting surfaces.

With reference to FIGS. 4 to 7 the configuration of the digger tooth B which is the same regardless of its application as a side, corner or center tooth will now be described in more detail.

The digger tooth designed as an integral preferably swaged part comprises a base 10 and a shank 11 with a broad bead 12 formed therebetween which as soon as the digger tooth has been inserted into its associated socket H protectively overlies the socket. The tooth shank in cross sectional configuration is a truncated pyramid forming an irregular hexagon and having two planar surfaces 14, 15 disposed opposite to each other, wherein the surface 14 with respect to the base 36 of the truncated pyramid constitutes the perpendicular contact surface, whereas the further surfaces 16, 17 and 18, 19 of the truncated pyramid disposed relatively opposite each other in pairs include an angle k of about 168°. The surface 15 is inclined at an angle $\delta$ (delta) of 10° to 14°, preferably of 12°.

Figure 4:
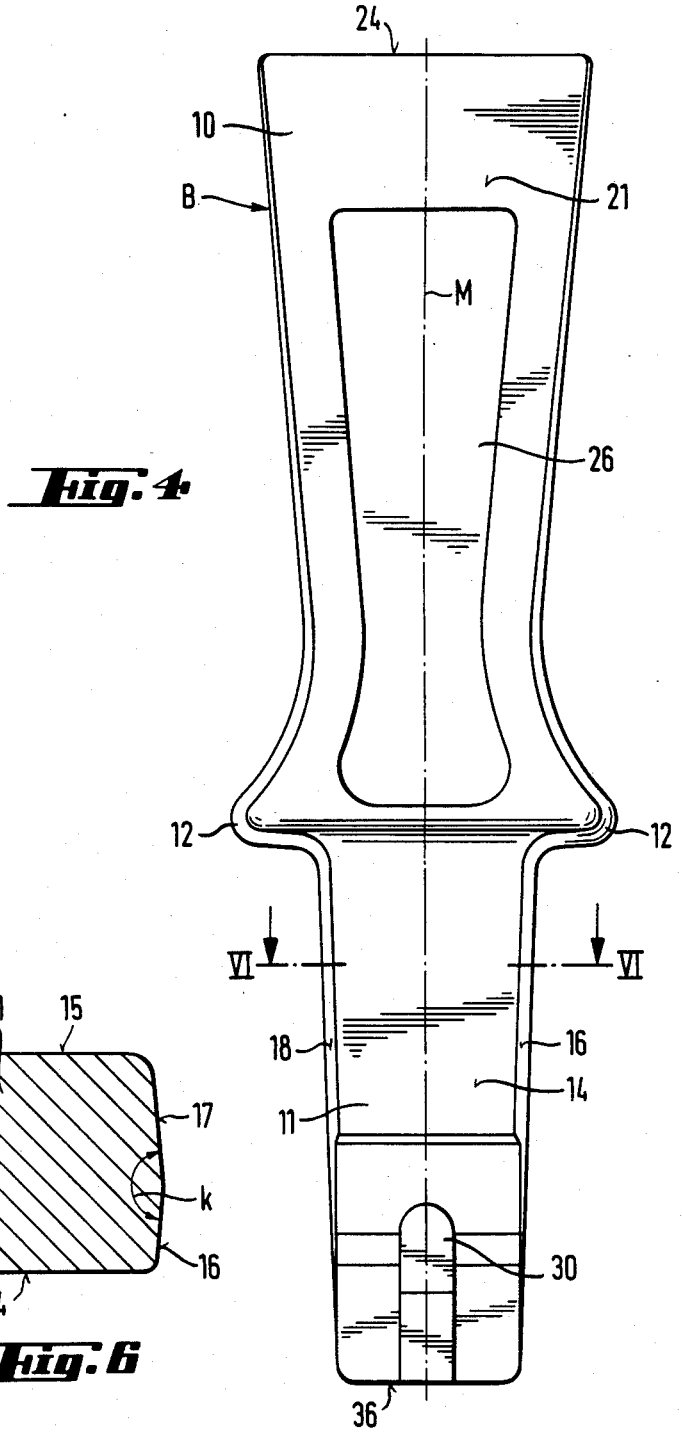
FIG. 4 is a plan view of a digger tooth constructed in accordance with the invention.
Figure 6:
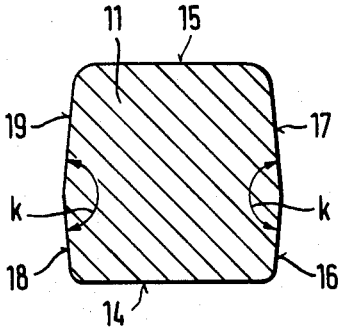
FIG. 6 is a sectional view taken along the line VI—VI of FIG. 4.
Figure 5:
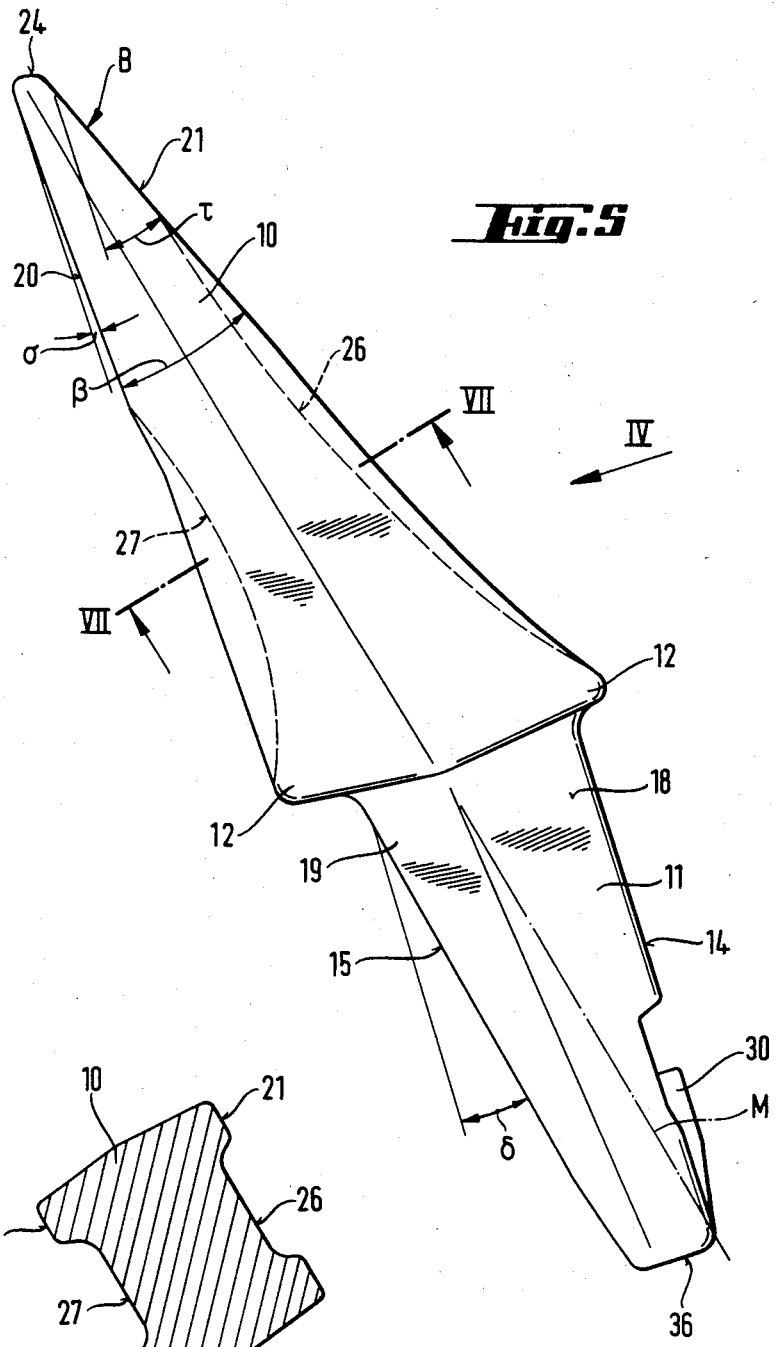
FIG. 5 is a side view of the digger tooth shown in FIG. 4.
Figure 7:
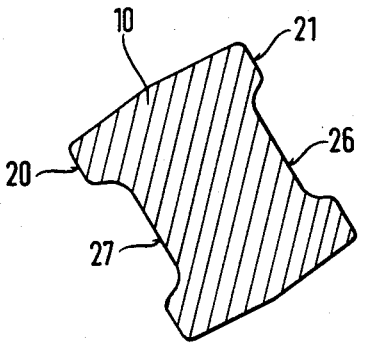
FIG. 7 is a sectional view taken along the line VII—VII of FIG. 5.

The pyramidal tooth base 10 has a bottom portion 20 and an upper portion 21, as best shown in FIG. 5. The bottom portion 20 with respect to the contact surface 14 of the digger tooth presents a surface positively inclined by an angle $\sigma$ (sigma) of 1° to 3°, preferably 2°, while the upper portion 21 relative to the same contact surface 14 presents a surface negatively inclined by an angle $\tau$ (tau) of 20° to 25°, preferably 23°. The faces of the tooth base disposed substantially at right angles thereto present, as shown in FIG. 4, a slight concave curvature. The rake angle $\beta$ (beta) of the tooth base is 19° to 22°, preferably 21°. In addition, the tooth base 10 in the area away from said cutting edge essentially forms a double T section, see also FIG. 7, so as to provide recesses 26 and 27 both on the upper portion 21 and the bottom portion 20, which constitute the so-called wear-resistant cutting edges.

Figure 8:
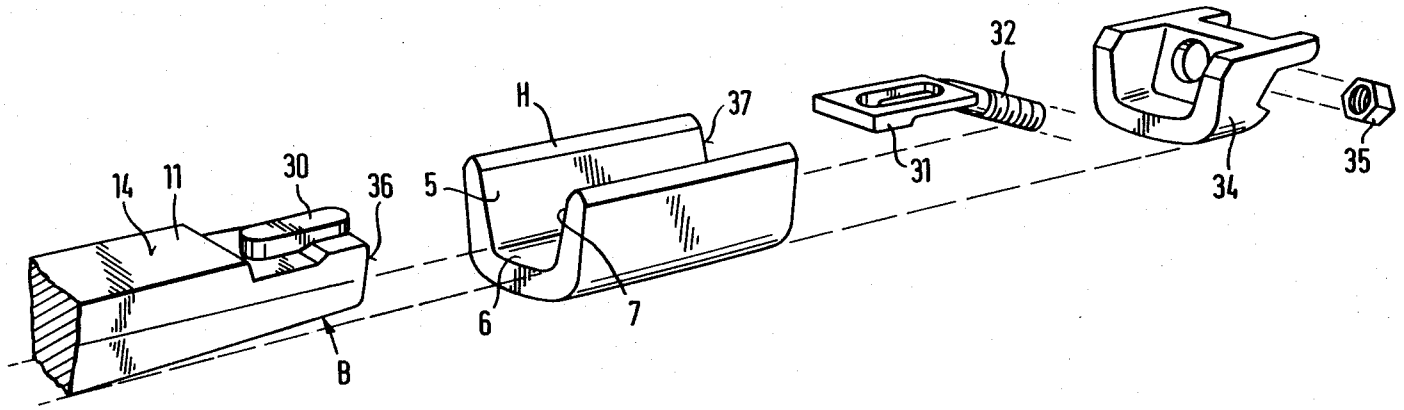
FIG. 8 is a perspective top plan view on the fastening means for the digger tooth of FIG. 4 comprising a retaining lug, a channel-shaped socket, a closure cap and a lock nut.

Finally, the contact surface 14 on the tooth shank 11 of the digger tooth B is provided with a projection or dog 30 adapted to be engaged by a retaining lug 31 connected to a threaded bolt 32 which extends through the end of the socket away from the digger tooth B and carries at its fee end a closure cap 34 which is secured by means of a lock nut 35 to the adjacent end of the socket, see FIGS. 1 and 8.

Using the fastening means just described the digger tooth B after insertion into the socket can easily be secured, as is also shown in FIGS. 1 and 3, the retaining elements being disposed near or close to the center axis M.

The angles of the bucket walls and the previously mentioned positive and negative angles $\sigma$ (sigma) and $\tau$ (tau) of the tooth portions 20 and 21 added, each digger tooth $B_4$ to $B_6$ after attachment to the bucket 1 is inclined at an angle $\alpha$ (alpha) in the range of 30° to 50°, preferably 43°, the clearance or relief angle $\gamma$ (gamma) ranging from 20° to 28°, preferably 23°, whereas the digger teeth $B_1$ to $B_3$ and $B_7$ to $B_9$ which are removably secured to the side walls 2, 3 are inclined at an angle $\alpha$ (alpha) in the range of 30° to 50°, preferably 48°, the clearance angle $\gamma$ (gamma) ranging from 20° to 28°, 18° being preferred, see FIG. 1. In selecting the angular relationships in this manner, it is possible to extend the useful life of the digger teeth and to ensure effective clearance of the bucket and consequently clearance of the bucket wheel, even when digging hard, consolidated material or when used for dredging.

When excavating buckets having perpendicular walls are used, it may be suitable for special applications to have all digger teeth arranged at the same angled positions with identical clearance angles. The relief angles $\gamma$ (gamma) in this case, may range from 2° to 48°, preferably 26°, the mounting angles from 20° to 28°, preferably 23°.

Figure 9:
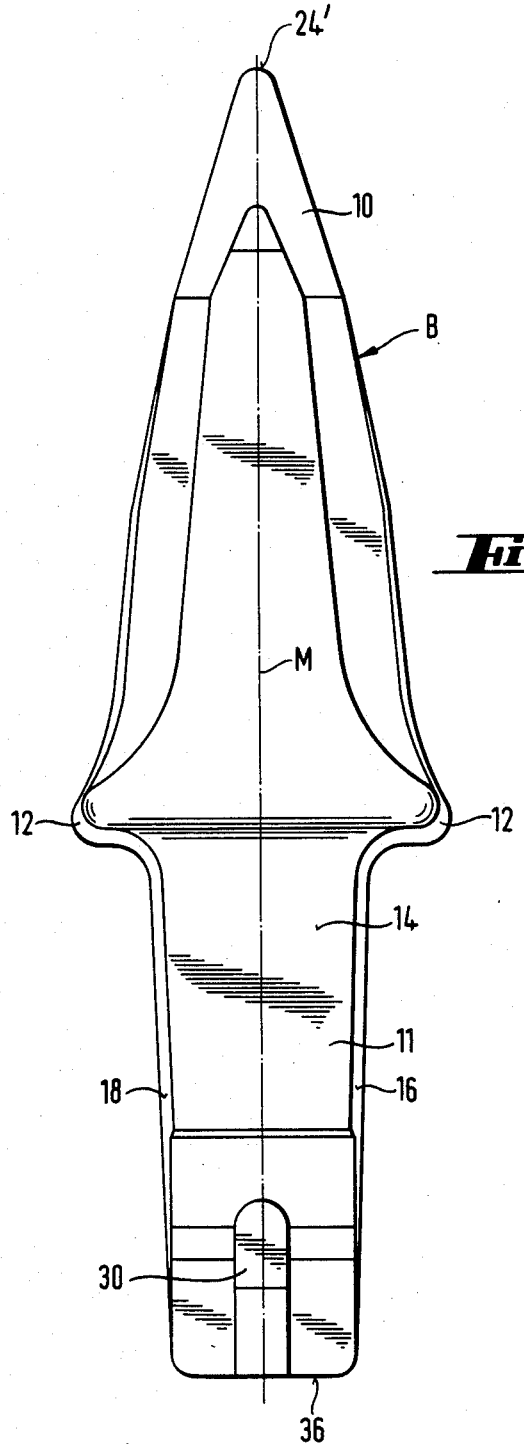
FIG. 9 is a digger tooth according to the invention and designed in the form of a pointed tooth.

As it may be necessary for certain applications to use pointed digger teeth, there is shown in FIG. 9 a modification of the previously described digger tooth B configured as a pointed tooth. Accordingly, with the general configuration remaining substantially the same, especially that of the tooth shank 11 and the bead 12, the tooth base 10 has the form of a known pointed cutting wedge ending in a point 24' instead of in a cutting edge 24.

What is claimed is:

1. An integrally formed digger tooth including a tooth base and a tooth shank with a bead serving as an abutment disposed therebetween for use in an arrangement of digger teeth wherein:

a. said tooth base has a bottom portion (20) which with respect to a planar contact surface (14) of the tooth shank presents a positively inclined surface ($\sigma$=sigma) of 1° to 3°, preferably 2°;

b. the upper portion (21) of the tooth base with respect to said contact surface (14) presents a surface ($\tau$=tau) negatively inclined between 20° to 25°, preferably 23°, wherein the rake angle ($\beta$=beta) of the tooth base (10) is 10° to 22°, preferably 21°; and c. said contact surface (14) is provided with a projection (30) to be engaged by a retaining lug (31), said retaining lug by means of a threaded bolt (32) extending through the end of said socket (H) away from the digger tooth and carrying a closure cap (34) said closure cap being secured by means of a lock nut (35) to the adjacent end (37) of said socket.

2. A digger tooth of claim 1, wherein the surface (15) of the tooth shank (11) disposed opposite of said planar contact surface (14) is inclined with respect to said surface (14) at an angle ($\sigma$=sigma) of 10° to 14°, preferably 12°.

3. A digger tooth arrangement for a bucket wheel excavator having buckets equipped with replaceable center, corner, and side teeth; wherein said teeth ($B_1$ to $B_9$) are all of identical configuration and dimensions and, on each bucket:

the center axis (M) of said center tooth lying parallel to the plane of rotation of said excavator and normal to the upper edge of said bucket;

the center axes (M) of said corner teeth ($B_4$, $B_6$) lying at equal and opposite inclination angles ($\eta_4$, $\eta_6$) from the plane of rotation of said excavator;

the center axes (M) of said side teeth ($B_1$ to $B_3$) lying at different inclination angles ($\eta_1$ to $\eta_3$) forward of normal to the upper edge of said bucket;

the center axes (M) of said side teeth ($B_7$ to $B_9$) lying at different inclination angles ($\eta_3$ to $\eta_1$) forward of normal to the upper edge of said bucket.

4. A digger tooth arrangement of claim 3 wherein the clearance angle ($\gamma$=gamma) of the digger teeth secured to said excavating bucket (1) is 2° to 48°, preferably 26°, said mounting angle ($\alpha$=alpha) being 20° to 28°, preferably 23°.

5. A digger tooth arrangement as defined in claim 3 wherein the inclination angle ($\eta_4$, $\eta_6$) of said corner teeth ($B_4$, $B_6$) is in the range of 10° to 20°, and the inclination angles ($\eta_1$, $\eta_2$, $\eta_3$) of said side teeth are in the range of 5° to 20°.

6. A digger tooth arrangement as defined in claim 5 wherein the inclination angle ($\eta_4$, $\eta_6$) of said corner teeth is in the range of 13° to 17° and the inclination angles ($\eta_1$, $\eta_2$, $\eta_3$) of said side teeth are at 5° increments.

7. A digger tooth arrangement as defined in claim 3 wherein said corner and center digger teeth ($B_4$ to $B_6$) are removably secured to the front wall of said bucket at a mounting angle ($\alpha$) with respect to the plane defined by the upper edge of said bucket, said mounting angle being in the range of 30° to 50°, and at a clearance angle ($\gamma$) in the range of 20° to 28°, and wherein said side digger teeth ($B_1$ to $B_3$ and $B_7$ to $B_9$) are removably secured to the sidewalls of said bucket at a mounting angle ($\alpha$) in the range of 30° to 50° and at a clearance angle ($\gamma$) in the range of 10° to 28°.

8. A digger tooth arrangement as defined in claim 7 wherein the mounting angle of said corner and center digger teeth is in the range of 41° to 45°, the clearance angle of said corner and center digger teeth is in the range of 22° to 24°, the mounting angle of said side digger teeth is in the range of 46° to 50°, and the clearance angle of said side digger teeth is in the range of 16° to 20°.

* * * * *